US012692048B1

(12) United States Patent
Shvartsman

(10) Patent No.: US 12,692,048 B1
(45) Date of Patent: Jul. 28, 2026

(54) SELF-OPENING PLASTIC BAG

(71) Applicant: Vladislav Shvartsman, Outremont (CA)

(72) Inventor: Vladislav Shvartsman, Outremont (CA)

( * ) Notice: Subject to any disclaimer, the term of this patent is extended or adjusted under 35 U.S.C. 154(b) by 0 days.

(21) Appl. No.: 19/556,807

(22) Filed: Mar. 4, 2026

Related U.S. Application Data

(60) Provisional application No. 63/879,931, filed on Sep. 11, 2025.

(51) Int. Cl.
*B65D 33/00* (2006.01)

(52) U.S. Cl.
CPC ..... *B65D 33/007* (2013.01); *B65D 33/002* (2013.01)

(58) Field of Classification Search
CPC ..... B65D 33/002; B65D 33/007
USPC ..... 383/35
See application file for complete search history.

(56) References Cited

U.S. PATENT DOCUMENTS 3,510,054 A * 5/1970 Di Carlo ..... B65D 75/5811 383/41
4,787,517 A * 11/1988 Martin ..... B65D 75/5855 383/203
4,904,092 A * 2/1990 Campbell ..... B65D 33/002 206/390
5,290,104 A * 3/1994 Sengewald ..... B65D 33/002 206/554
5,706,961 A * 1/1998 Morano ..... B65D 33/007 383/35
5,921,390 A * 7/1999 Simhaee ..... B65D 85/671 206/390
6,305,572 B1 * 10/2001 Daniels ..... B65D 33/002 206/390
6,945,695 B2 * 9/2005 Rabiea ..... B65B 43/267 383/35
8,979,367 B2 * 3/2015 Tan ..... B65H 75/32 383/8
9,180,999 B2 * 11/2015 Castro ..... B65D 33/001
9,926,158 B2 * 3/2018 Brouilette ..... B65H 16/028
11,718,456 B2 * 8/2023 Shen ..... B65D 33/2508 383/35
2002/0020648 A1 * 2/2002 Lam ..... B65D 33/002 206/390
2003/0053720 A1 * 3/2003 Smith ..... B65D 33/002 493/212
2006/0188180 A1 * 8/2006 Otsubo ..... B65D 33/001 383/35
2011/0268373 A1 * 11/2011 Polland ..... B65D 33/007 383/65

* cited by examiner

*Primary Examiner* — Peter N Helvey

(57) ABSTRACT

A roll of self-opening plastic bags separated by perforations, each bag having an openable mouth at its top and a weld at its bottom. A skirt of material extends from the weld of one bag to the perforation between the end of the skirt and the mouth of an adjacent bag. A patch is bonded to the skirt of one bag, over the perforation, and to the mouth of the adjacent bag. During separation of bags, the patch creates a gripping tab on the adjacent bag's mouth and breaks cling forces between the mouth's opposing walls, resulting in a bag that can be opened without licking fingers, while wearing gloves, or for users with reduced hand mobility.

8 Claims, 5 Drawing Sheets

SELF-OPENING PLASTIC BAG

This application claims priority of U.S. Provisional Patent Application No. 63/879,931, filed Sep. 11, 2025.

The present invention relates to a method of manufacturing plastic bags that are wound into rolls. Each bag is fitted with a tab on its mouth so that once a bag is removed off the roll, the tab facilitates locating the mouth, and opening the bag. This is useful for all bags that are wound in a roll, from dog waste to produce bags, and eliminates the need to lick one's fingers to open the bag. The present invention also makes opening bags a painless experience for people with various hand disabilities such as arthritis.

BACKGROUND

It is common for people to struggle with plastic bags that won't open, particularly bags that come off a roll. For example, most dog walkers purchase bags on a roll for economic and space-saving reasons. Static cling is allegedly the main force that prevents the bag's mouth from opening, but there are other potential forces such as a vacuum between the inner walls, molecular welding, and Van Der Waals forces at work. Usually, a person has to lick their fingers to separate the bag's walls to force open the bag's mouth.

Licking fingers is not desirable when a finger's hygiene is questionable, or if the person is wearing gloves. In a grocery store, salubrity of the cart and environment can be questionable, and having to lick fingers to open a produce bag is an unpleasant experience for many.

Another common problem is identifying which end of the bag is the mouth. Both sides look identical, and people unnecessarily waste time searching for the mouth.

In most prior art, each bag can be torn off the roll along a perforation line stamped between bags, each perforation line separating the bottom of the leading bag and the mouth of the following bag (or vice versa). A perforation line typically comprises alternating cut segments and tie portions.

Some rolls of bags are wound side to side, with a perforation line between their sides. This side-to-side winding configuration is not relevant to the present invention.

It would be immensely practical for bags to have a gripping tab available at their mouths so that the user can identify which end is the mouth, grab the tab, and easily pull the bag open.

There is known U.S. Pat. No. 5,816,027 for "Method For Manufacturing Stackable Plastic Handle Bags With Releasable Adhesive", wherein stacked t-shirt bags have a patch of adhesive between their mouths, and pulling one bag off the stack of bags causes the adhesive patch to disrupt cling forces of the mouth of the subsequent bag, thus rendering the next bag open.

There is also known U.S. Pat. No. 8,979,367 for SELF OPENING BAGS WITH ATTACHING FEATURES, wherein there is at least one attaching feature on a bag's exterior, basically a tacky material that deforms a spot near the mouth of the following bag once the leading bag is torn off the roll. The present invention is simpler, and works in a different way.

There is also known U.S. Pat. No. 3,979,050 for MULTIPLY FILM ARTICLES, wherein deformation of the bags' mouths is performed with a heating element, thus adding a 'pucker' to the edges of the bag's mouth once it is ready for use. This prior art solves the problem of bags that won't open without moist fingers, but its implementation is more complicated than the present invention. This prior art needs a heating element at 200 degrees F., and each bag has to stop for 0.5 seconds during winding onto a roll.

There is also known US20060188180 for PLASTIC BAGS WITH GRIPPING TABS. While this prior art is useful, it requires special bags with tabs to be designed and manufactured. The present invention can be added to any thermoplastic bag manufacturing process without the need to design new a bag.

There is also known U.S. patent application Ser. No. 19/300,667 for SELF-OPENING PLASTIC BAG, which is the closest prior art to the present invention. This prior art discloses a short adhesive patch adhered over a perforation line separating two bags between one bag's mouth and over a subsequent bag's heat weld. This assures that a small portion of the bag's mouth is torn to vitiate or break cling forces. In the present invention, the patch does not encroach on the subsequent bag's weld, the patch extends past the perforation line, but not as far as the weld. The present invention utilizes a useless remnant of the manufacturing process, a skirt portion that is typically found on most plastic bags that are made on a roll. This subtle shift in patch placement causes a surprisingly different result. Not only does the resulting tab offer a tactile and visual clue as to where the bag's mouth is, but the force of removal of one bag from the other also breaks cling forces, thus making the bag easier to open, even wearing mittens.

SUMMARY OF THE INVENTION

All plastic bags that are wound on a roll have a portion commonly referred to as the "skirt" below their heat weld. This portion of the bag is useless, a byproduct of the manufacturing process: the heat weld is made first, then a perforation machine punches a perforation line as close to the weld as possible. The closer the perforation line is to the weld, the bigger the volume of the resulting bag. However, it is typically not possible to punch a perforation line precisely over the weld, so there is a "skirt" of useless plastic material between a perforation line and the weld.

The present invention utilizes an attachment element that tears out a part of the skirt and to make a tab that protrudes above one of the walls of a plastic bag's mouth for easier opening. The tab identifies the bag's mouth and provides a leverage point for the user to grab and force open the bag.

The shearing force associated with tearing off a bag causes the tab to induce a differential displacement between the walls of the bag's mouth, which are normally held in tight contact by cling forces.

In the preferred embodiment, the attachment element comprises a one-inch label, a "patch", bonded over the perforation line separating two bags. The patch bridges adjacent bags, simultaneously being bonded onto the skirt of one bag, over the perforation line, and onto the mouth of the adjacent bag.

Presuming the roll of bags dispenses the bags mouth-first, once a user tears off the leading bag, the patch, staying bonded to the mouth of the following bag, rips off a small part of the leading bag's skirt. The part of the skirt that was ripped off the leading bag, i.e. the bag that was just torn off, remains bonded to the top of the patch, thus becoming a gripping tab on the mouth of the following bag. In the preferred embodiment at least 60% of the patch is bonded to the mouth portion, and not more than 40% of the patch is bonded to the skirt portion. Otherwise, the patch will tear off a small part of the mouth of the following bag rather than the skirt of the leading bag, which is not as desirable.

During separation of adjacent bags along the perforation line, forces generated by the separation act predominantly on only one wall of the bag's mouth, through the patch. The interaction between the patch and only one wall of the mouth region locally disrupts cling forces that keep the mouth closed.

In some embodiments, the patch may exhibit deformation characteristics different from those of the bag material, including reduced elongation, increased stiffness, thickness variation, or composite construction, such that deformation of one mouth wall differs from deformation of an opposing mouth wall during separation, thereby facilitating opening of the bag.

The patch can be any shape and made of any material. The preferred range of sizes is between 0.25" (6.35 mm) to 1.5" (38.1 mm) in length and between 0.1" (2.54 mm) and 1" (25.4 mm) in width. The patch's bonding strength does not have to be very strong, since the application of force to the patch is a shear force, i.e. parallel to the plane of the patch as bonded, rather than a normal or axial force, i.e. in a perpendicular direction from the patch, which may cause the patch to peel off the bag's mouth without leaving a tab.

Manufacture of this new and improved bag will be very simple: in the production line, right before the bags are wound onto a spool, the manufacturer can retrofit a machine to bond patches to the correct places on the bags. The preferred method of manufacture on an industrial scale is a label applicator, bonding patches to bags between the bag perforation line stage and the bag winding stage.

DETAILED DESCRIPTION OF THE DRAWINGS

There are two ways plastic bags can be dispensed off a roll of bags: bottom-first, or mouth-first. Bags can be wound onto a physical core, or wound without a core. Some bags are wound after being folded, but they can be wound unfolded, or folded into other configurations, such as with gussets.

In the preferred embodiment, all references and drawings will disclose the mouth-first configuration. However, the invention works equally well with the bottom-first winding method, except the grabbing tab is created on the following bag (the bag that was just torn off) instead of the leading bag (i.e. the bag that is next on the roll).

The present invention helps to open a plastic bag once an immediately-adjoining plastic bag is torn off a roll of bags. It also offers a visual and tactile cue for the user as to which end is the bag's bottom and which end is the mouth. This is achieved by bridging adjoining bags with a bonded patch, and the user's action of tearing one bag off the roll causes the patch to remain attached to the adjoining bag's mouth, thereby creating a gripping tab for easy opening. The user grabs the gripping tab, and the bag can be easily pried open without having to lick or moisten one's fingers.

Figure 1:
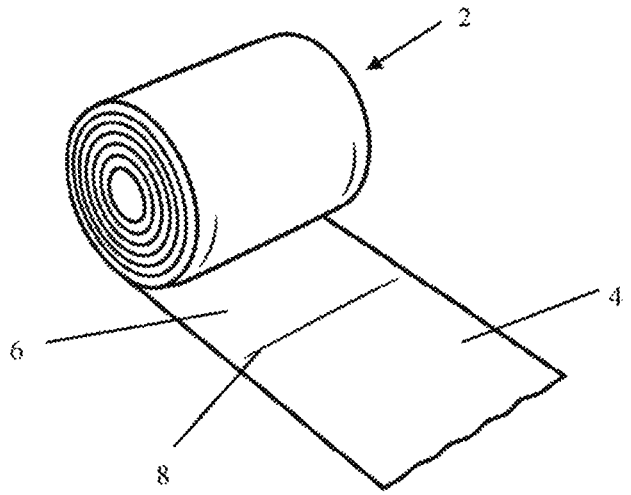
Figure 1 (Prior art)
FIG. 1 shows a perspective view of a prior art roll of bags.

Referring now to Figures, FIG. 1 shows a typical roll of dog waste bags 2, wound bottom-first, with a leading bag 4 separated from following bag 6 by perforation line 8. Perforation line 8 not only helps to cleanly tear off the leading bag, but can also be characterized as the transition between bottom 18 of leading bag 4 and mouth 16 of following bag 6 (as seen on FIG. 2).

Figure 2:
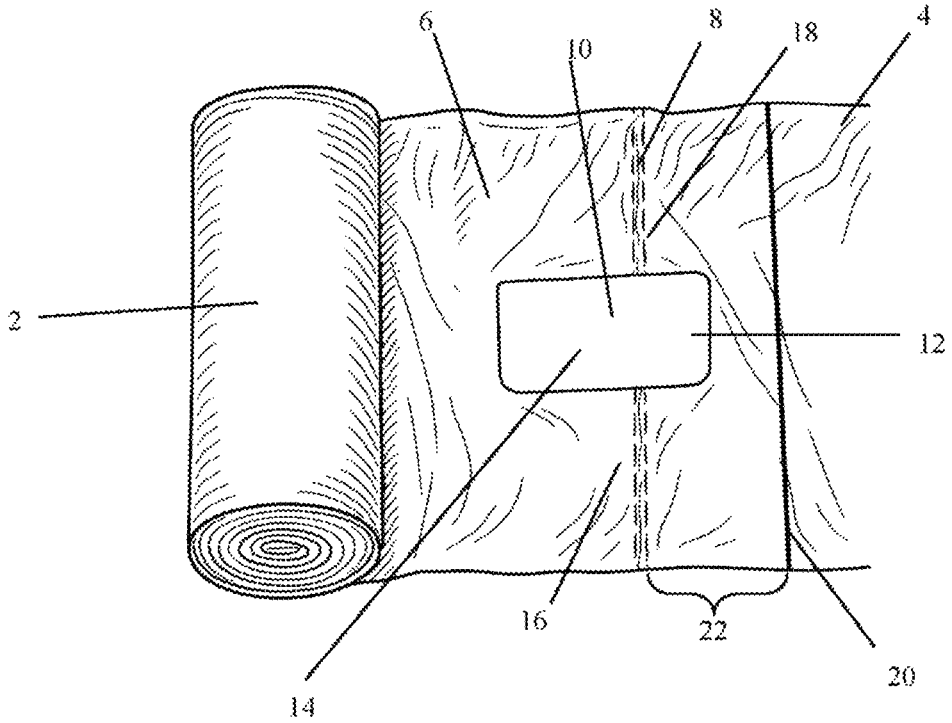
FIG. 2 shows a perspective view of a leading and following bag with the present invention.

FIG. 2 shows the present invention, namely roll of bags 2, with patch 10 bridging leading bag 4 and following bag 6 over perforation line 8. Most plastic bags of this type comprise a skirt 22 between bag 4's weld 20 and bag 4's bottom 18 (abutting perforation line 8). Skirt 22 has no useful purpose, and is a byproduct of the manufacturing process. Breaching skirt 22's structural integrity has no repercussions on bag 4's performance, i.e. tearing any part of skirt 22 (between weld 20 and bag bottom 18) will not cause a hole to be ripped in bag 4 since there is no structural breach of bag 4's integrity above weld 20.

As shown in the preferred embodiment, patch 10 is bonded to leading bag 4's skirt 22, bottom 18, perforation line 8, and onto following bag 6's mouth 16. Patch 10 comprises two portions: gripping tab 12, being approximately 40% of patch 10's length, gripping tab 12 being bonded to leading bag 4's skirt 22, and mouth tab 14, being approximately 60% of patch 10's length, bonded onto following bag 6's mouth 16.

In the preferred embodiment, patch 10 is 1" (25.4 mm) in length and 0.25" (6.35 mm) in width, but can be between 0.25" (6.35 mm) and 3" (73.2 mm) in length, and between 0.1" (2.54 mm) and 1" (25.4 mm) in width. Although the preferred embodiment shows patch 10 as rectangular, patch 10 can be any shape: round, oval, square, or a custom shape.

Patch 10 can be bonded to plastic bags in a variety of ways: adhesive bonding, welding, lamination, thermal attachment, ultrasonic weld, mechanical attachment, co-formation, or any other technique capable of locally modifying mechanical behavior of one wall of the bag relative to the opposing wall. In the preferred embodiment, patch 10 comprises a label that cannot be torn with fingers, ideally applied with a label applicator.

In another embodiment, the patch 10 possesses mechanical properties differing from those of the bag material such that separation of bags 2 and 4 produces unequal deformation of opposing mouth 16 walls.

Figure 3:
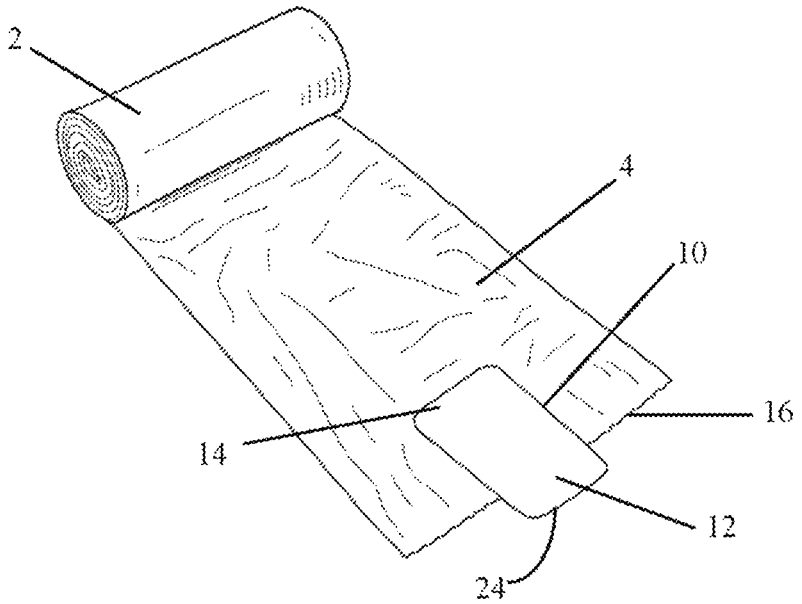
FIG. 3 shows a folded leading bag on a roll of bags with a tab at its mouth.

FIG. 3 demonstrates a formerly following bag 6, now the new leading bag 4, after the previous leading bag 4 had been torn off roll 2. Patch 10's mouth tab 14 remains bonded to mouth 16. Gripping tab 12 is available to the user for easily opening bag 4. Portion 24 (not shown) of previous leading bag 4's skirt 22 remains bonded to gripping tab 12.

Figure 4:
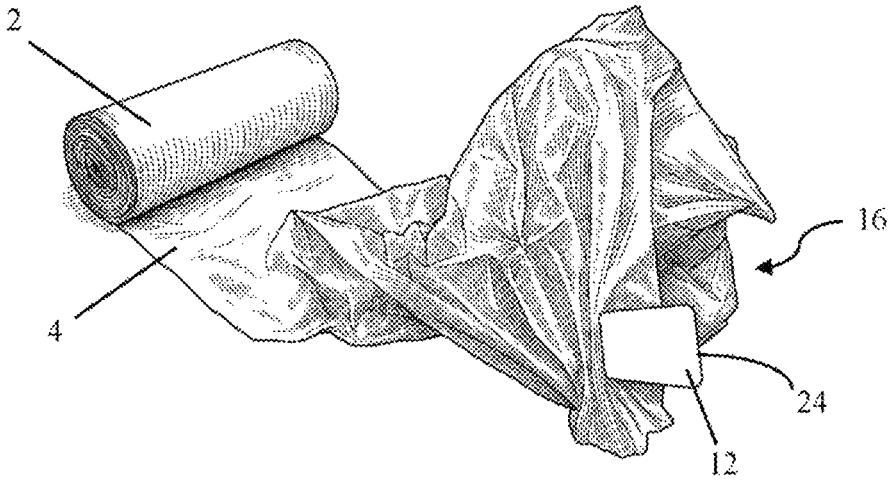
FIG. 4 shows an open, leading bag on a roll of bags with a tab on its mouth.

FIG. 4 shows leading bag 4 of FIG. 3 in open configuration. The physical force involved in tearing off previous leading bag 4 causes patch 10 to exert a shear force onto one wall of following bag 6's mouth 16, thereby vitiating or breaking cling forces and making bag 4 easier to open. By pulling on gripping tab 12, users can pry apart bag 4 without licking fingers.

Figure 5:
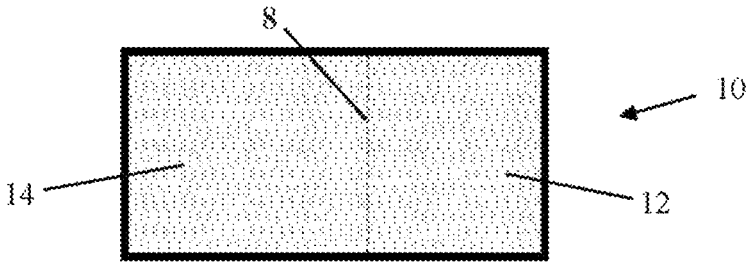
FIG. 5 shows a patch of the present invention, showing segments that are bonded to leading and following bags.

FIG. 5 shows patch 10 as shown on FIG. 2, with mouth tab 14 being substantially 60% of patch 10, and gripping tab 12 being substantially 40% of patch 10. For illustration purposes, placement of perforation line 8 is shown.

Figure 6:
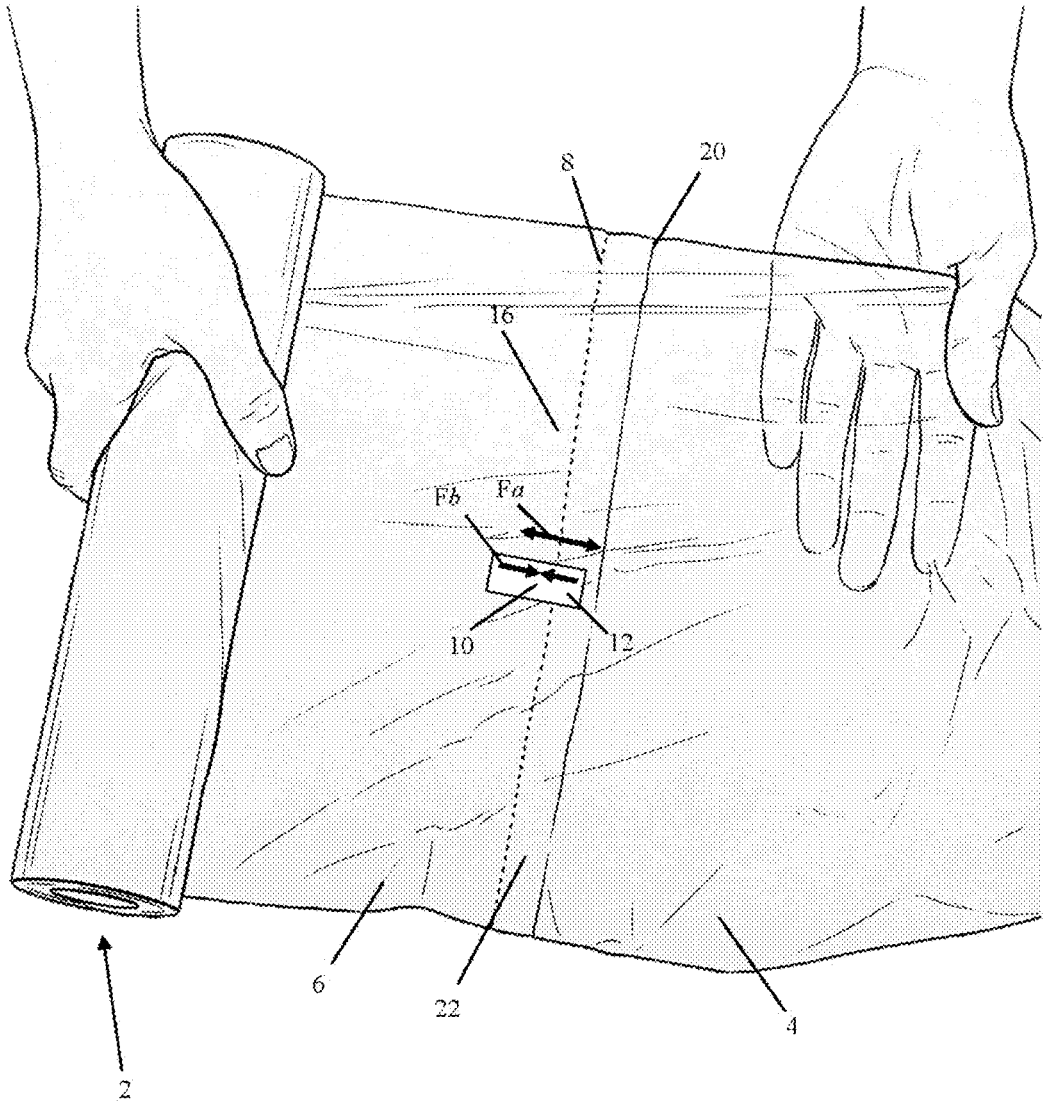
FIG. 6 shows a roll of plastic bags for produce with the present invention, the leading bag being torn off.

FIG. 6 shows roll 2 of plastic bags for food, produce, or any other item that may be stored in such a bag. Leading bag 4 is in the process of being separated from following bag 6 along perforation line 8. To remove bag 4 from bag 6, user exerts Force Fa, which causes bags 4 and 6 to slightly stretch or deform at perforation line 8 because of the elastic nature of the plastic material. However, patch 10 exerts Force Fb due to patch 10's greater stiffness than bags 4 and 6, and patch 10 remains substantially undeformed during the separation process.

The temporary moment of imbalance between Forces Fa and Fb during bag separation, acting on only one wall 16 of bag 6's mouth, causes patch 10 to break the cling forces keeping bag 6's mouth 16 from opening by creating a fissure in mouth 16's cling seal. Patch 10's material should be less elastic than bag 4 and 6 material, because if patch 10 is as elastic as bags 4 and 6, it will stretch along Fa Force and offer no countering Force Fb to break mouth 16's cling seal.

Figure 7:
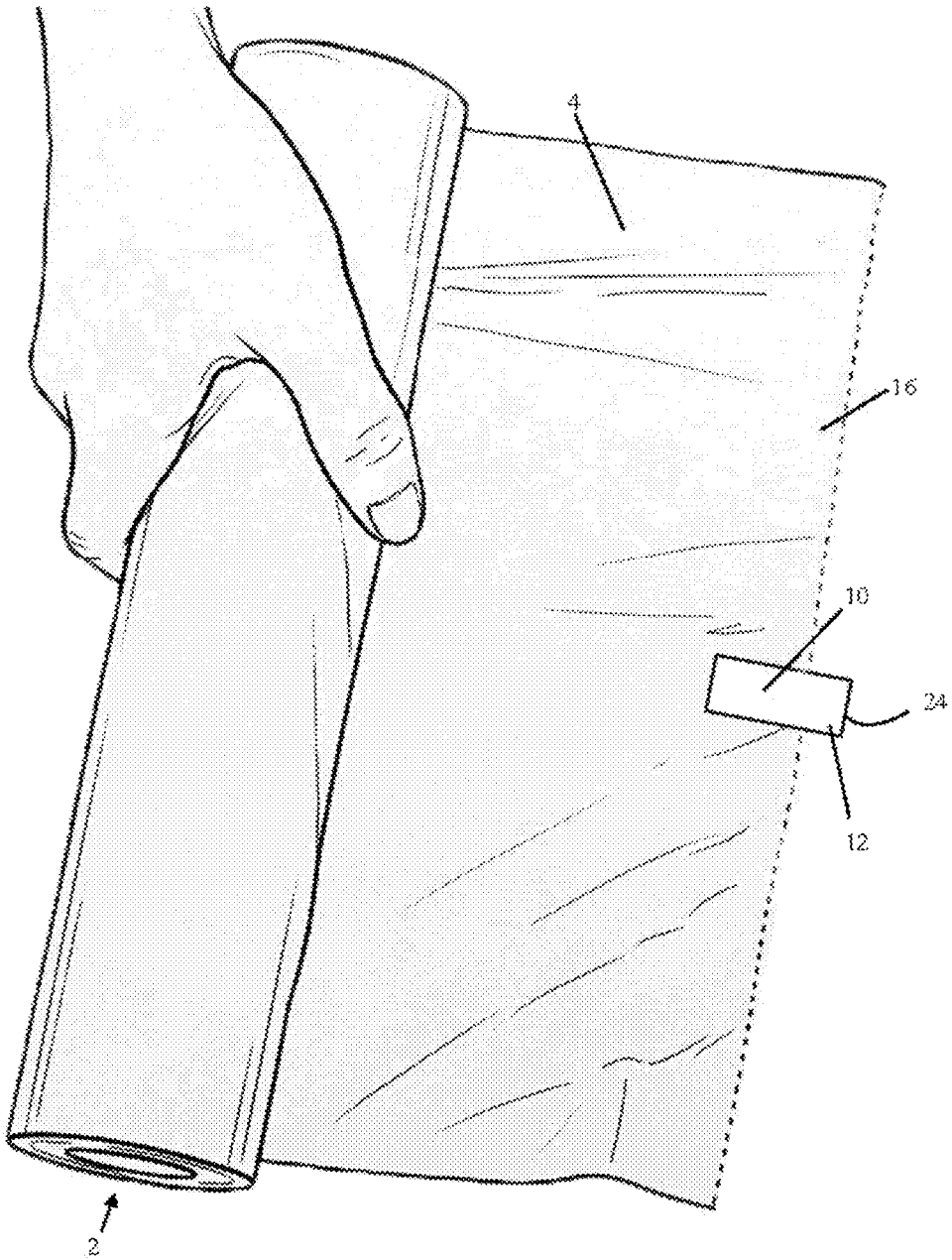
FIG. 7 shows the result of tearing off a leading bag, as seen in FIG. 6.
Figure 8:
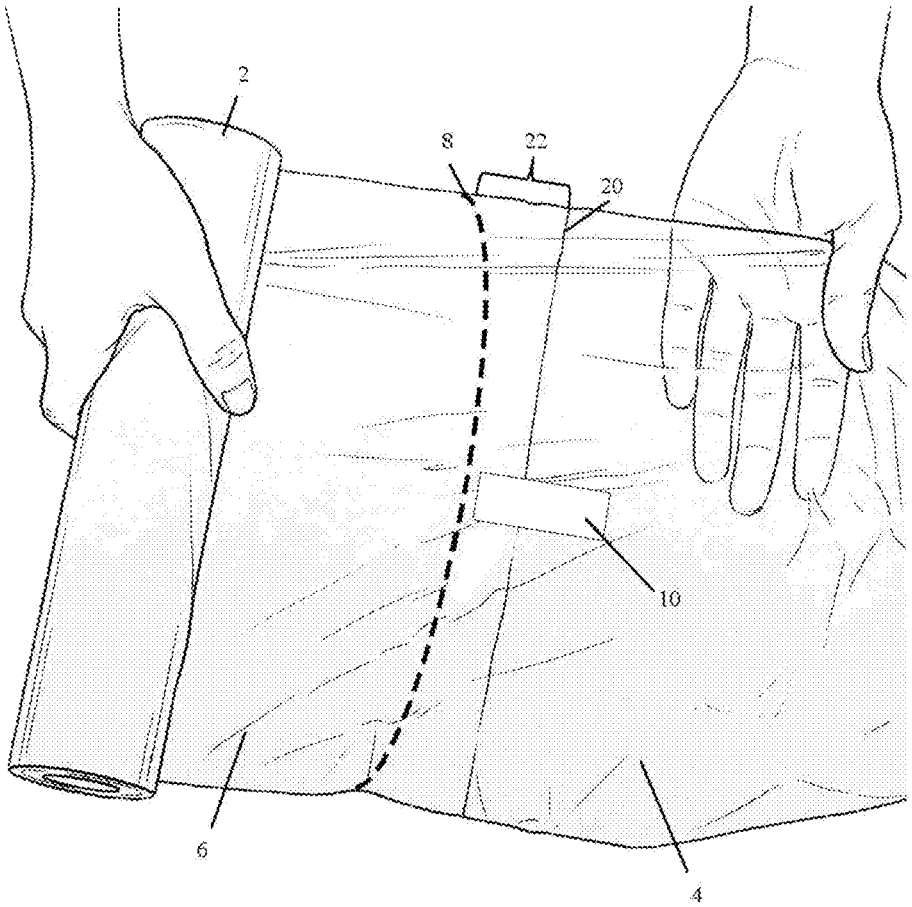
FIG. 8 shows the present invention on a roll of bags separated by a curved perforation line.

FIG. 7 shows roll 2 after bag 4 was removed in FIG. 6. New leading bag 4 has patch 10 bonded to mouth 16, with skirt 22's ripped-off portion 24 (not shown) bonded to the underside of patch 10's gripping tab 12. Mouth 16 is no longer clamped shut by cling forces. FIG. 8 shows bags with non-standard perforation line 8 to demonstrate that patch 10 can be bonded to bags 4 and 6 as long as one bag has skirt 22.

In operation of the result of the present invention, adjacent bags can be separated in two different ways: with one sharp pull, or by tearing perforation line 8 one tie portion at a time. In either case, once adjacent bags start separating at perforation line 8, patch 10 performs two functions: (1) gripping tab 12 tears out the portion of skirt 22 that gripping tab 12 is bonded to, and (2) patch 10's mouth tab 14 exerts a slight shear force on one wall of bag 6's mouth 16, thus vitiating or breaking mouth 16's cling forces. The end result is an easily-openable mouth 16.

Although the invention has been described with reference to specific embodiments, examples, and structural configurations, it will be understood that these are illustrative and not limiting. Various modifications, substitutions, rearrangements, and equivalents may be employed without departing from the spirit and scope of the invention as defined by the appended claims.

Elements described in connection with one embodiment may be combined with elements of other embodiments unless expressly stated otherwise. Likewise, features described as optional, preferred, or advantageous in certain embodiments may be incorporated into other embodiments as appropriate.

Unless explicitly recited in the claims, no structural, dimensional, material, orientation, or operational limitation is intended to be implied from the foregoing description. Directional terms (e.g., "upper," "lower," "upward," "downward," "transverse," "longitudinal") are used solely for convenience of description and do not require any particular orientation in use.

Terms such as "comprising," "including," "having," and similar open-ended terms are intended to mean "including but not limited to." The singular forms "a," "an," and "the" include plural referents unless the context clearly dictates otherwise.

Where components are described as being "configured to," "adapted to," or "operative to" perform a function, such language is intended to encompass any structure capable of performing the stated function, including equivalent and analogous structures, whether or not specifically described herein.

The scope of the invention is defined solely by the appended claims and their legal equivalents.

The invention claimed is:

1. A roll of self-opening bags, comprising:

a plurality of plastic bags wound into said roll, each said bag of said plurality of plastic bags comprising:

a length and a width, a top portion, wherein said top portion comprises a mouth adapted to be opened, and a bottom portion, wherein said bottom portion comprises a weld across said width, and a skirt portion between said weld and said top portion of an immediately-adjacent bag of said plurality of plastic bags, wherein each of said bags of said plurality of plastic bags is separated by a perforation line, said perforation line being located between said skirt portion of said one said bag of said plurality of plastic bags and said top portion of said immediately-adjacent said bag of said plurality of plastic bags, wherein said perforation line facilitates a removal of said one said bag from said immediately-adjacent said bag, and an attachment element with a length and a width, bonded onto said skirt portion, over said perforation line, and onto said top portion of said immediately-adjacent said bag, wherein said removal of said one said bag from said immediately-adjacent said bag causes said attachment element to tear out a part of said skirt portion of said one said bag, said attachment element thereby forming a tab portion projecting from said top portion of said immediately-adjacent said bag.

2. The roll of self-opening bags according to claim 1, wherein said roll of self-opening bags is wound onto a core.

3. The roll of self-opening bags according to claim 1, wherein said roll of self-opening bags is wound without a core.

4. The roll of self-opening bags according to claim 1, wherein said attachment element comprises a label.

5. The roll of self-opening bags according to claim 1, wherein said attachment element comprises cellulose tape.

6. The roll of self-opening bags according to claim 1, wherein said attachment element comprises paper tape.

7. The roll of self-opening bags according to claim 1, wherein said attachment element's length is at least 0.25", and said attachment element's width is at least 0.1".

8. The roll of self-opening bags according to claim 1, wherein said removal causes said attachment element to disrupt cling forces preventing said mouth from opening.

* * * * *